US006376809B1

(12) United States Patent
Huber et al.

(10) Patent No.: US 6,376,809 B1
(45) Date of Patent: Apr. 23, 2002

(54) COOKTOP WITH DISPLAY ELEMENTS

(75) Inventors: Johann Huber, Inzell; Gerhard Busalt, Traunreut, both of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/624,446

(22) Filed: Jul. 24, 2000

Related U.S. Application Data

(63) Continuation of application No. PCT/EP99/00365, filed on Jan. 20, 1999.

(51) Int. Cl.[7] ..... H05B 3/68
(52) U.S. Cl. ..... 219/445.1; 219/448.11
(58) Field of Search ..... 219/445.1, 446.1, 219/447.1, 448.11, 448.12, 448.13; 345/173, 174, 175

(56) References Cited

U.S. PATENT DOCUMENTS 3,416,251 A * 12/1968 Bordner ..... 40/564
4,121,204 A * 10/1978 Welch et al. ..... 345/174
4,290,061 A * 9/1981 Serrano ..... 345/174
4,304,976 A * 12/1981 Gottbreht et al. ..... 219/702
5,155,338 A * 10/1992 Hoffman ..... 219/445.1
5,717,189 A * 2/1998 Goetz et al. ..... 219/445.1
5,809,680 A * 9/1998 Scheidler et al. ..... 219/445.1

* cited by examiner

*Primary Examiner*—Sang Paik
(74) *Attorney, Agent, or Firm*—Laurence A. Greenberg; Werner H. Stemer; Ralph E. Locher

(57) ABSTRACT

A cooktop includes a printed circuit board having an upper side and operating elements on the upper side, a glass-ceramic cooking area having a plurality of cooking locations, and display elements. Each of the display elements have an illuminator and a display-symbol mask. The illuminator is assigned to one of the operating elements, is disposed underneath the glass-ceramic cooking area, and is secured on and in contact with the upper side of the printed-circuit board. The display-symbol mask is secured on the illuminator and is disposed between the glass-ceramic cooking area and the illuminator such that, when the illuminator is in operation, a display symbol corresponding to the display-symbol mask is seen through the glass-ceramic cooking area when viewed from above the glass-ceramic cooking area. The glass-ceramic cooking area can have no printed display-symbol inscription provided thereon, and/or can have no decorative printed inscription provided in a region on the surface above the illuminator. Further, the display-symbol mask can be secured on the illuminator at a distance from the underside of the glass-ceramic cooking area.

8 Claims, 1 Drawing Sheet

COOKTOP WITH DISPLAY ELEMENTS

CROSS-REFERENCE TO RELATED APPLICATION

This is a continuation of copending International Application PCT/EP99/00365, filed Jan. 20, 1999, which designated the United States.

BACKGROUND OF THE INVENTION

FIELD OF THE INVENTION

The invention lies in the field of household appliances. The invention relates to a cooktop appliance.

A cooktop is disclosed in German Published, Non-Prosecuted Patent Application DE 44 24 847 A1. The cooktop has transparent surface regions of glass and/or glass ceramic, and the display is presented through the glass and/or the glass ceramic. The device for displaying information on cooktop operating states has a fastening part that is securely connected to the glass or the glass ceramic by adhesive bonding. A least one display unit adapted to the fastening part can be connected to the fastening part. Furthermore, the fastening part has receiving devices, into which individually shaped text and/or symbol masks, for example, are snap-fitted. A particular disadvantage of this device is that the bonding technique for securing the fastening part for the display symbol masks is complex due to the temperatures and the mechanical loads occurring.

A further cooktop is disclosed in German Utility Model G 87 01 926 U. The display elements essentially include two components. First, a string of light-emitting diodes are disposed underneath the cooktop panel. Second, a printed inscription is applied to the surface of the cooktop panel. The inscription shows, for example, an ascending numerical sequence from 1 to 10. The corresponding light-emitting diode is disposed alongside or at a distance from the Arabic number that corresponds to the cooking stage set on the cooktop operating element that is active. A particular disadvantage of this cooktop is that the exact and uniform spatial alignment of a light-emitting diode to its associated informational inscription or number has to be ensured. In practice, ensuring the alignment is complex due to assembly and/or production tolerances.

SUMMARY OF THE INVENTION

It is accordingly an object of the invention to provide a cooktop with display elements that overcomes the hereinafore-mentioned disadvantages of the heretofore-known devices of this general type and that eliminates the disadvantages of the generic cooktops.

With the foregoing and other objects in view, there is provided, in accordance with the invention, a cooktop, including a printed circuit board having an upper side and operating elements on the upper side, a glass-ceramic cooking area having a plurality of cooking locations, and display elements each having an illuminator assigned to one of the operating elements, disposed underneath the glass-ceramic cooking area, and secured on and in contact with the upper side of the printed-circuit board, and a display-symbol mask secured on the illuminator and disposed between the glass-ceramic cooking area and the illuminator, such that when the illuminator is in operation, a display symbol corresponding to the display-symbol mask is seen through the glass-ceramic cooking area when viewed from above the glass-ceramic cooking area.

The invention makes possible, in particular, low-cost pre-assembly and pre-testing of the printed-circuit module with a contacted illuminator, display symbol mask secured on it, and an operating element. The exact spatial configuration between the operating and display elements disposed on the printed-circuit board and the display symbol mask is ensured in a low-cost way.

According to a preferred embodiment, no printed display-symbol inscription is provided on the surface of the glass-ceramic cooking area. Due to the very restricted visibility through the glass-ceramic cooking area, there is advantageously no display symbol of any kind visible for an operator in the switched-off state of the cooktop. The display area appears to a viewer essentially as a black area. Only the operating elements, for example, operating elements integrated in the cooktop frame, or a conventional printed operating-symbol inscription on the surface of the glass-ceramic panel are visible for an operator. Only, for example, after the cooktop is switched on, and, consequently, when corresponding selected illuminators are switched on, are the display elements visible. As a result, the action of switching on the cooktop is indicated better visually and, at the same time, a clear separation between display elements and operating elements is achieved. Furthermore, the configuration according to the invention permits no spatial discrepancy between the printed display-symbol inscription and the illuminator at a small viewing angle of an operator with respect to the horizontal.

To simplify and improve the display further, according to a preferred embodiment, no decorative printed inscription is provided on the surface of the glass-ceramic cooking area in a region above the illuminator.

The display-symbol mask is advantageously secured on the illuminator at a distance from the underside of the glass-ceramic cooking area. Because the underside of the glass-ceramic panel is highly profiled, attaching the mask directly on the underside would have the effect of impairing the quality of the display.

Other features that are considered as characteristic for the invention are set forth in the appended claims.

Although the invention is illustrated and described herein as embodied in a cooktop with display elements, it is, nevertheless, not intended to be limited to the details shown since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1B is a plan view of the cooktop of FIG. 1 after the cooktop has been switched on;

DESCRIPTION OF THE PREFERRED EMBODIMENTS

Figure 1A:
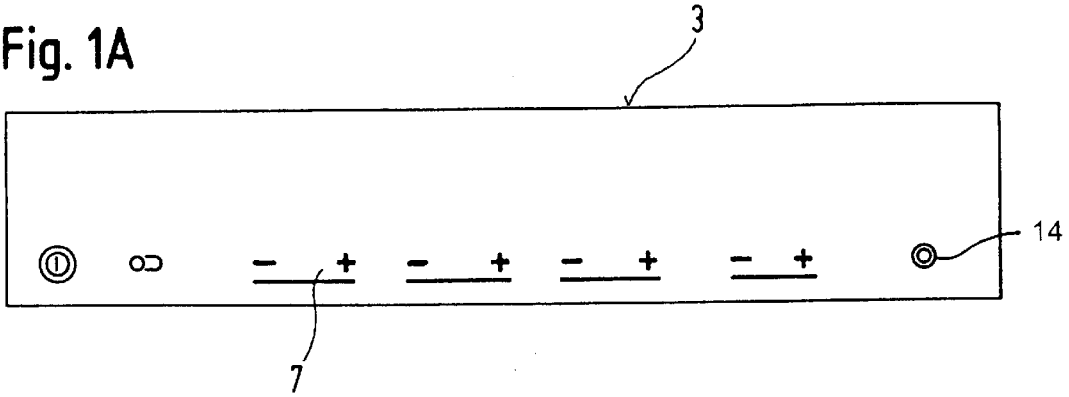
FIG. 1A is a plan view of the cooktop according to the invention in a switched-off state.

In all the figures of the drawing, sub-features and integral parts that correspond to one another bear the same reference symbol in each case.

Figure 1B:
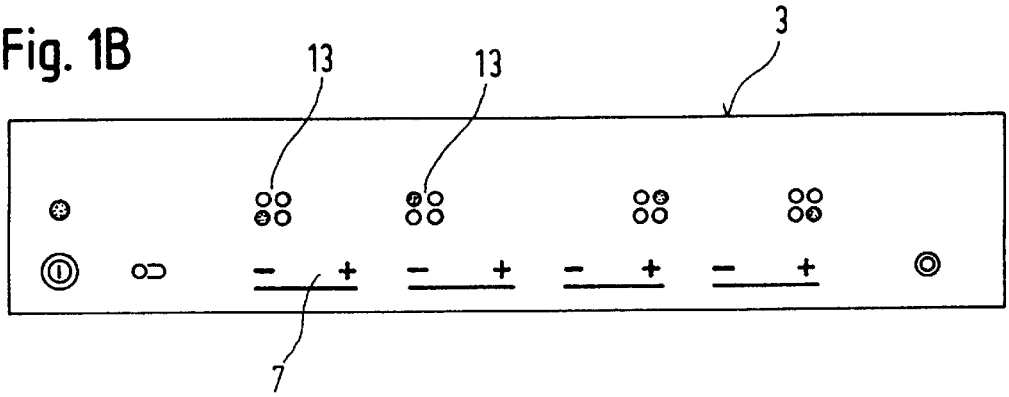
Figure 1C:
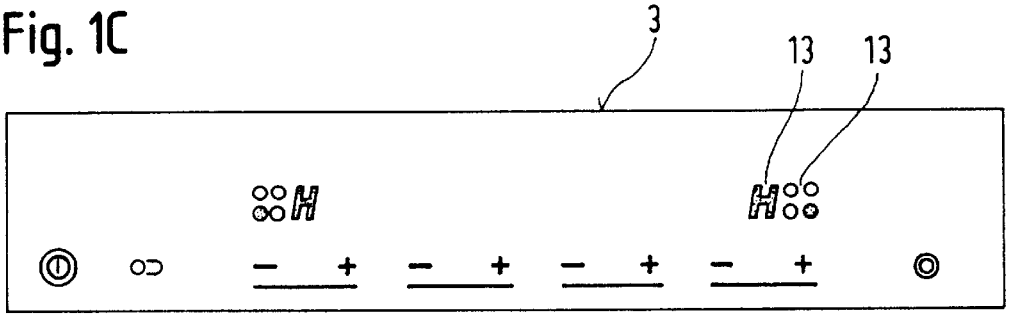
FIG. 1C is a plan view of the cooktop of FIG. 1 in a switched-off state with active residual heat display.

Referring now to the figures of the drawings in detail and first, particularly to FIGS. 1A to 1C thereof, there is shown a portion of a cooktop 1, in particular, a portion of a glass-ceramic cooktop panel 3 of the cooktop 1. The cooktop 1 has operating elements 5. Each of the operating elements 5 has a printed operating-symbol inscription 7 on the surface of the cooktop panel 3 and a switching device 9 disposed approximately exactly underneath the inscription 7 under the cooktop panel 3. See FIG. 2. By touching the cooktop panel 3 in the region of the printed operating-symbol inscription 7, the switching device 9 detects, for example, based on a change in capacitance or through optical scanning, the operator's desire to operate a portion of the cooktop, and a corresponding action of the cooktop 1 is carried out. The switching device 9 is in contact with a printed circuit board 11 disposed underneath the cooktop panel 3 (FIG. 2).

FIG. 1A shows the cooktop 1 in the switched-off state. For an operator, only the surface of the cooktop panel 3, and, consequently, the printed operating-symbol inscription 7, can be seen in the displayed portion. Display symbols are not seen in the switched-off state of the cooktop 1. When the cooktop 1 is switched on (FIG. 1B), various display elements 13 are visible for the operator for the first time. For example, after switching the cooktop on, display elements 13 can be seen above the four printed "–" and "+" operating-symbol inscriptions 7 respectively disposed in pairs. These inscriptions 7 visually indicate which of the four cooking points or areas can be changed with respect to cooking power by the corresponding "–" and "+" knobs. When the two-circuit heating symbol 14 on the right-hand edge of the cooktop panel 3 in FIGS. 1A to 1C is actuated, a suitable non-illustrated symbol becomes visible, for example, in a row with the further display elements 13 at a corresponding distance from the printed operating-symbol inscription 7.

Figure 2:
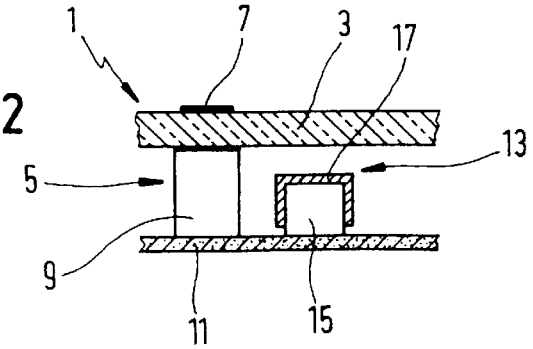
FIG. 2 is a simplified, fragmentary, cross-sectional side view of an operating element and an associated display element of the cooktop according to the invention.

According to FIG. 2, an illuminator 15, shining approximately exclusively in the direction of the glass-ceramic cooktop panel 3 brings about the display. The illuminator 15 is on the printed-circuit board 11 and in contact with the printed-circuit board 11. Fitted on the illuminator 15 is a suitably shaped covering panel 17 that is light-transmitting in accordance with the contour of the display symbol to be represented. When the main switch or a functional switch, for example, for the two-circuit heating, is touched by a user's finger, the corresponding switching device 9 detects the actuation. Furthermore, the corresponding illuminators 15, inter alia, are supplied with voltage. The illuminator 15 has adequate luminosity to ensure an adequately sharp and clear optical impression for an operator when viewing the cooktop panel 3. In the region above the illuminator 15 with its covering panel 17 there is neither a decorative printed inscription nor, in particular, a printed display inscription.

After the cooktop 1 has been switched off (FIG. 1C), a suitable non-illustrated switching configuration detects residual heat possibly present at the individual cooking locations. Given the presence of a critical residual heat, the switching configuration activates the two illuminators 15 disposed alongside each other, with their respective covering panels 17. As a result, a display of the critical cooking location appears because it is still warm. Additionally, the letter "H" appears as an indication that residual heat is still present (FIG. 1C).

We claim:

1. A cooktop, comprising:

a printed circuit board having an upper side and operating elements on said upper side;

a glass-ceramic cooking area having a plurality of cooking locations; and display elements each having:

an illuminator assigned to one of said operating elements, disposed underneath said glass-ceramic cooking area, and secured on and in contact with said upper side of said printed-circuit board; and a display-symbol mask secured on said illuminator and disposed between said glass-ceramic cooking area and said illuminator, for showing a display symbol corresponding to said display-symbol mask through said glass-ceramic cooking area when viewed from above said glass-ceramic cooking area while said illuminator is in operation.

2. The cooktop according to claim 1, wherein said glass-ceramic cooking area has a surface, and no printed display-symbol inscription is provided on said surface.

3. The cooktop according to claim 1, wherein said glass-ceramic cooking area has a surface, and no decorative printed inscription is provided in a region on said surface above said illuminator.

4. The cooktop according to claim 1, wherein said glass-ceramic cooking area has an underside and said display-symbol mask is secured on said illuminator at a distance from said underside.

5. In a cooktop having a glass-ceramic cooking area with a plurality of cooking locations, a display, comprising:

a printed circuit board having an upper side and operating elements on said upper side; and display elements each having:

an illuminator assigned to one of said operating elements, disposed underneath the glass-ceramic cooking area, and secured on and in contact with the upper side of said printed-circuit board; and a display-symbol mask secured on said illuminator and disposed between the glass-ceramic cooking area and said illuminator for showing a display symbol corresponding to said display-symbol mask through the glass-ceramic cooking area when viewed from above the glass-ceramic cooking area while said illuminator is in operation.

6. The display according to claim 5, wherein the glass-ceramic cooking area has a surface, and no printed display-symbol inscription is provided on the surface.

7. The display according to claim 5, wherein the glass-ceramic cooking area has a surface, and no decorative printed inscription is provided in a region on the surface above said illuminator.

8. The display according to claim 5, wherein the glass-ceramic cooking area has an underside and said display-symbol mask is secured on said illuminator at a distance from the underside.

* * * * *

UNITED STATES PATENT AND TRADEMARK OFFICE

CERTIFICATE OF CORRECTION

PATENT NO. : 6,376,809 B1
DATED : April 23, 2002
INVENTOR(S) : Johan Huber et al.

It is certified that error appears in the above-identified patent and that said Letters Patent is hereby corrected as shown below:

Title page,
Item [30], should read as follows:

-- Jan. 23, 1998 (DE) …… 198 02 571 --

Signed and Sealed this

Twenty-fourth Day of September, 2002

*Attest:*

*Attesting Officer*

JAMES E. ROGAN
*Director of the United States Patent and Trademark Office*